United States Patent [19]

Bergman

[11] Patent Number: 4,623,365

[45] Date of Patent: Nov. 18, 1986

[54] RECIRCULATING ELECTRIC AIR FILTER

[75] Inventor: Werner Bergman, Pleasanton, Calif.

[73] Assignee: The United States of America as represented by the Department of Energy, Washington, D.C.

[21] Appl. No.: 690,022

[22] Filed: Jan. 9, 1985

[51] Int. Cl.[4] ..... B03C 3/00

[52] U.S. Cl. ..... 55/131; 55/498

[58] Field of Search ..... 55/6, 124, 131, 154, 55/498, 473, 467; 210/448, 497.01

[56] References Cited

U.S. PATENT DOCUMENTS

| | | | |
|---|---|---|---|
| 1,693,741 | 12/1928 | Wuest | 210/448 |
| 3,016,984 | 1/1962 | Getzkin | 210/497.01 |
| 4,244,710 | 1/1981 | Burger | 55/6 |
| 4,339,250 | 7/1982 | Thut | 55/467 |

FOREIGN PATENT DOCUMENTS

| | | | |
|---|---|---|---|
| 821900 | 9/1969 | Canada | 55/131 |
| 1367701 | 9/1974 | United Kingdom | 55/498 |

*Primary Examiner*—Bernard Nozick

*Attorney, Agent, or Firm*—Henry P. Sartorio; L. E. Carnahan; Judson R. Hightower

[57] ABSTRACT

An electric air filter cartridge has a cylindrical inner high voltage electrode, a layer of filter material, and an outer ground electrode formed of a plurality of segments moveably connected together. The outer electrode can be easily opened to remove or insert filter material. Air flows through the two electrodes and the filter material and is exhausted from the center of the inner electrode.

13 Claims, 2 Drawing Figures

RECIRCULATING ELECTRIC AIR FILTER

The U.S. Government has rights in this invention pursuant to Contract No. W-7405-ENG-48 between the U.S. Department of Energy and the University of California, for the operation of Lawrence Livermore National Laboratory.

BACKGROUND OF THE INVENTION

The invention relates to air filters and more particularly to electric air filters.

Recirculating air filters are self contained air cleaning units that are designed to supplement existing ventilation systems. In contrast to the conventional air filtration system that removes contaminated air from a room, the recirculating air filter cleans the contaminated air within the room by recirculating the room air through a filter in a multi-pass operation.

Recirculating air filters have become very popular in recent years to remove particulates from industrial work environments because of the substantial savings in heating and cooling costs. Portable room air cleaners that recirculate filtered air into the room have also become widely used in office and factory environments. These portable recirculting air filters supplement the existing ventilation system. The key difference between a conventional air filter and a recirculating air filter is that the recirculating air filter discharges its exhaust into the same volume that is being filtered while the conventional air filter discharges its exhaust into another volume. The same filter element may be used in either application.

There are many commercially available recirculating air filters that use mechanical air filter media or electrostatic precipitator elements. These commercial units have disadvantages that place serious limitations on their performance and application. The recirculating air filter using mechanical air filter media suffer because the air flow resistance increases sharply as the filter efficiency increases. Thus, a compromise is required between the amount of air passing through the cleaner and the efficiency of the cleaner. Adding a more powerful air blower to increase the air flow is undesirable because of increased initial cost, energy consumption and noise. In an office environment, noise is often the most important factor. The major problems with recirculating air filters using electrostatic precipitator elements are the ozone generation and the high initial cost. The recirculating electric air filter in this invention overcomes the limitations of commercially available units.

Typical available filter cartridges are sealed units consisting of high voltage and ground electrodes, filter media and support and sealing flanges. These cartridges were designed to have repeated cycles of particle deposit formation and removal prior to discarding the entire unit when the filter reaches its maximum dust holding capacity. The replacement of these prior art filter cartridges on a very frequent schedule to meet the 10 gram limit is impractical because of the filter costs, labor costs, and costs for interrupting the fuel fabrication process. Also the filter cartridge unit cannot be easily disassembled or compressed for reduction of the volume of waste for disposal.

In the fuel processing application it is desirable to maintain the general configuration of a cylindrical filter cartridge which mounts onto a blower. However, instead of the filter cartridge being an integral unit, a cartridge designed for easy disassembly and replacement of the filter media is highly advantageous. It is also desirable to make the entire unit as compact as possible.

Accordingly, it is an object of the invention to provide a filter cartridge which can be easily disassembled and reassembled.

It is also an object of the invention to provide a filter cartridge in which the filter media can be readily replaced.

SUMMARY OF THE INVENTION

The recirculating electric air filter according to the invention is based on a standard recirculating air filter using mechanical air filter media. The invention utilizes the electrification of mechanical filter media that greatly increases the filter efficiency. This allows a low air resistance filter media to be used in the recirculating air filter. The filter media is electrified by sandwiching the media between two air permeable electrodes. The invention also provides an outer electrode structure which facilitates removing the mechanical filter media.

A filter cartridge according to the invention has a cylindrical inner high voltage electrode and a hinged outer ground electrode which can be easily opened to insert or remove a filter media. The inner electrode is a perforated metal cylinder or screen to which a high voltage can be applied. A plurality of non-conducting spacers are placed around the high voltage electrode to maintain a fixed distance between the high voltage and ground electrodes. The outer ground electrode is a perforated metal cylinder formed of two or more segments which are hinged together and held together by securing means such as compression clamps. Pliable sheets of filter material, typically glass fiber mats are easily installed by removing the outer electrode and wrapping the filter media around the inner electrode. The outer electrode can then be replaced as easily as it was removed.

DETAILED DESCRIPTION OF A PREFERRED EMBODIMENT

Figure 1:
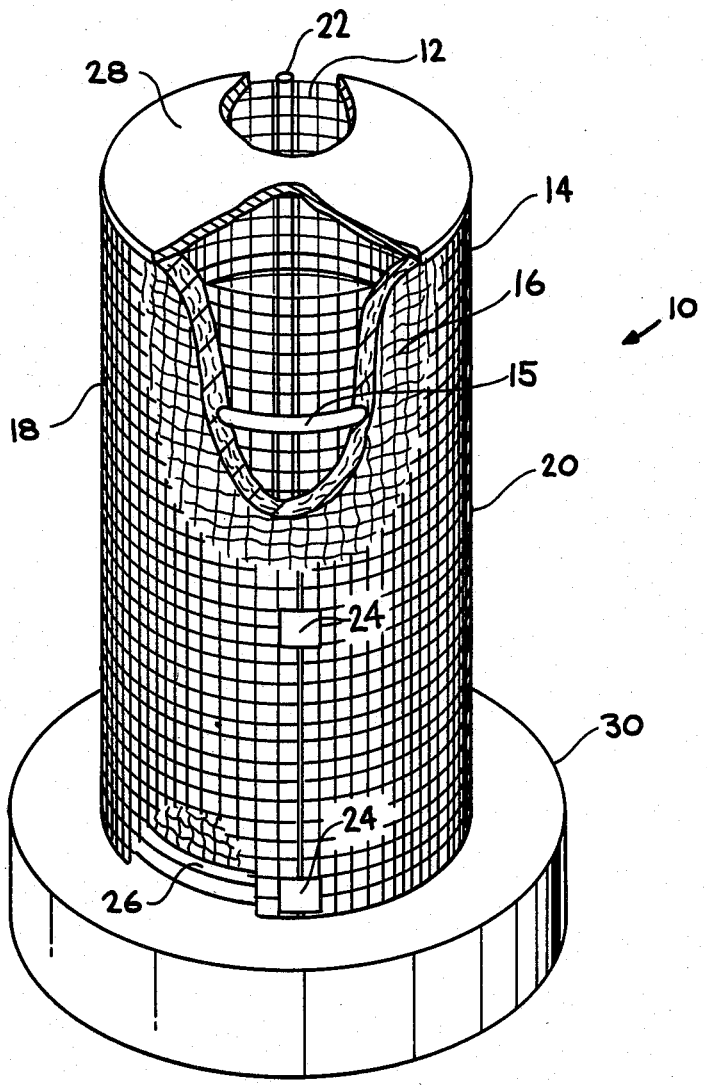
FIG. 1 shows a filter cartridge having a removable outer ground electrode.
Figure 2:
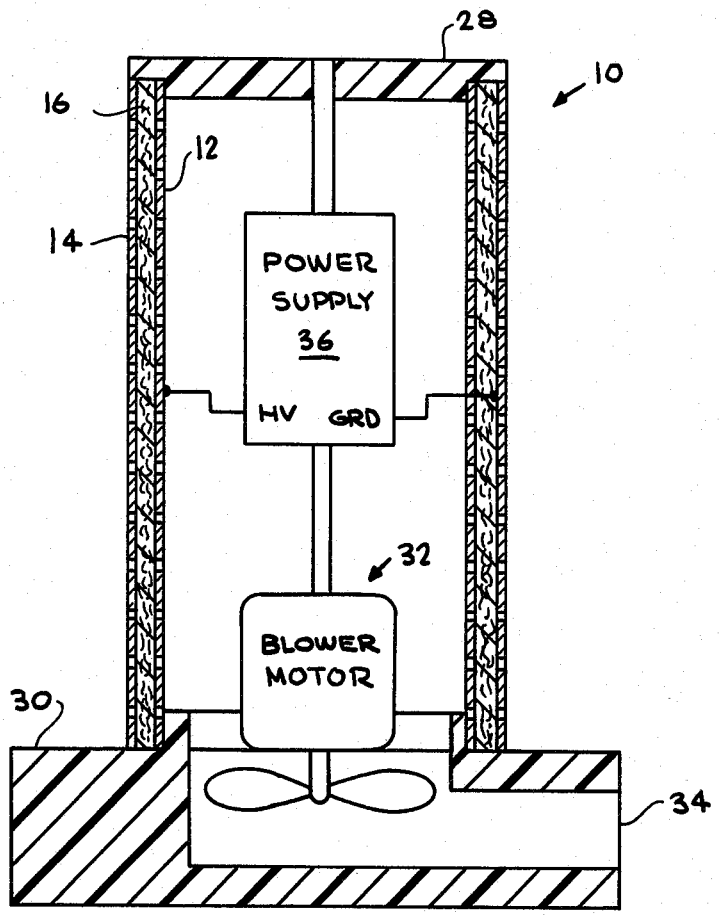
FIG. 2 shows a sectional view of the air filter of FIG. 1.

As shown in FIGS. 1 and 2 filter cartridge 10 has a hollow cylindrical inner electrode 12 and a concentric removable outer electrode 14 enclosing therebetween a layer of filter material 16. The inner electrode 12 is the high voltage electrode and is formed of a screen or perforated metal cylinder, e.g., aluminum, which may be reinforced at both ends and in the middle to maintain structural rigidity. A plurality of insulated spacers 15, e.g., O-rings or closed cell foam strips, are placed around the high voltage electrode to maintain electrode spacing. The outer electrode 14 is also formed of a screen or perforated metal cylinder. The outer electrode 14 is the ground electrode and is formed of a plurality of segments movably attached together so that the outer electrode 14 can easily be opened for removal and closed for reinstallation. In the illustrative embodiment shown in FIG. 1 the outer electrode 14 is made of two half cylinders 18 and 20 attached together by hinge 22 and secured together by securing means 24, e.g. compression clamps. Alternatively, the electrodes may be other shapes than cylindrical, e.g., square or rectangular.

The filter cartridge 10 is mounted on a base 30 which contains a pump or blower 32 which communicates with the interior of inner electrode 12. An insulating flange 26, e.g., made of plexiglass, provides a sealing edge between the inner electrode 12 and outer electrode 14 at the end of the cylindrical filter cartridge 10 which contacts base 30. The other end of filter cartridge 10 is sealed with a flat insulating plate 28, e.g., made of plexiglass, so that air may not flow in through the end of filter cartridge 10 and bypass the filter. In operation air is drawn from the interior of inner electrode 12 by the pumping means 32 in base 30 and exhausted through port 34. Air flows through the perforations in outer electrode 14 through filter material 16 and out through the perforations in inner electrode 12. Alternatively, the flow direction can be reversed. When the air flows from the inside out, a precharger can be placed inside to increase particle charge for increased collection efficiency. A high voltage (DC) typically up to 8–10 kV (DC) is applied, e.g., by power supply 36, to the inner electrode 12 to electrostatically remove particles from the recirculated air, thereby increasing filter efficiency. The filter cartridge 10 and base 30 form a compact unit since part of the mechanism mounted on base 30 can be contained within the interior of cartridge 10. The unit thus also runs very quietly.

The filter material 16 is a flat sheet of pliable material which may be selected from a variety of filter media, e.g., glass fibers or polymeric fibers. In one particular embodiment the filter media is a glass fiber mat, e.g., AF-18 commercially available from Johns Manville Company, Denver, Co. The pliable filter media 16 remains in place when wrapped around the inner electrode 12. Typically, a sheet of material $\frac{3}{8}$ inch thick is utilized which is sufficiently thin to avoid distortions as outer electrode 14 is clamped together, but has sufficient compressibility to ensure an adequate seal around the top and bottom flanges 26 and 28 when outer electrode 14 is clamped in place.

In operation, the outer electrode 14 is easily removed by unfastening the securing means 24 and opening the outer electrode segments 18 and 20 about the hinge 22 so the outer electrode 14 can be removed from filter cartridge 10. The sheet of filter material 16 can then be removed and replaced with a new sheet of material. The segments 18 and 20 of outer electrode 14 are then closed over the inner electrode 12 and the layer of filter material 16 and the securing means 24 are refastened. Thus, the operations of removing and reinstalling the outer electrode 14 are readily accomplished. The filter cartridge can be operated continuously until the filter media 16 is ready for disposal. The old filter media 16 can then be quickly removed and the new filter media 16 installed. The cost is minimized since only the layer of filter material 16 is replaced and discarded. The time required is minimal since the replacement can be done so quickly.

With 8 kV applied to the inner electrode 12 the filter has an efficiency of 96%.

Changes and modifications in the specifically described embodiments can be carried out without departing from the scope of the invention which is intended to be limited only by the scope of the appended claims.

I claim:

1. A recirculating electric air filter comprising:

a hollow air permeable inner high voltage electrode connected to a DC high voltage source;

a removable filter material surrounding the inner electrode;

an electrically grounded outer air permeable ground electrode mounted around, spaced apart from and electrically insulated from the inner electrode and containing the filter material therebetween, the outer electrode being formed of a plurality of segments moveably connected together to allow easy disassembly for removing the filter material;

the inner electrode, filter material, and outer electrode defining an air flow path therethrough between the exterior of the outer electrode and interior of the inner electrode;

an insulated sealing flange at one end of the electrodes for providing a seal between the inner and outer electrode;

an insulated plate at the opposite end of the electrodes for providing a seal across the end of the air filter;

a base having the electrodes mounted thereto and containing a blower means for drawing air out from or blowing air into the inner electrode.

2. The air filter of claim 1 wherein the inner electrode comprises a perforated metal cylinder.

3. The air filter of claim 2 wherein the inner electrode is formed of aluminum.

4. The air filter of claim 1 wherein the filter material is a pliable polymeric filter media.

5. The air filter of claim 1 wherein the filter material is a glass fiber media.

6. The air filter of claim 1 wherein the outer electrode is formed of a perforated metal cylinder.

7. The air filter of claim 1 wherein the outer electrode is formed of two segments.

8. The air filter of claim 1 wherein the outer electrode segments are held in a closed position around the inner electrode by securing means.

9. The air filter of claim 1 further including a plurality of insulating spacers mounted on the high voltage electrode to maintain electrode separation.

10. The air filter of claim 1 wherein the inner and outer electrodes have openings therethrough for the passage of air.

11. The air filter of claim 1 wherein the inner electrode is formed of a screen.

12. The air filter of claim 1 wherein the outer electrode is formed of a screen.

13. The air filter of claim 1 wherein the inner electrode is at a voltage of about 8–10 kV(DC).

* * * * *